US011271279B2

(12) United States Patent
Du et al.

(10) Patent No.: US 11,271,279 B2
(45) Date of Patent: Mar. 8, 2022

(54) DUAL-MODE RESONATOR, FILTER, AND RADIO FREQUENCY UNIT

(71) Applicant: HUAWEI TECHNOLOGIES CO., LTD., Guangdong (CN)

(72) Inventors: Xiaoliang Du, Shanghai (CN); Dan Liang, Shanghai (CN); Jiyong Guo, Shanghai (CN)

(73) Assignee: Huawei Technologies Co., Ltd., Guangdong (CN)

( * ) Notice: Subject to any disclaimer, the term of this patent is extended or adjusted under 35 U.S.C. 154(b) by 0 days.

(21) Appl. No.: 17/028,126

(22) Filed: Sep. 22, 2020

(65) Prior Publication Data

US 2021/0005948 A1 Jan. 7, 2021

Related U.S. Application Data

(63) Continuation of application No. PCT/CN2019/079317, filed on Mar. 22, 2019.

(30) Foreign Application Priority Data

Mar. 22, 2018 (CN) ..... 201810241048.X

(51) Int. Cl.
*H01P 1/207* (2006.01)
*H01P 7/06* (2006.01)
*H01P 1/208* (2006.01)

(52) U.S. Cl.
CPC ..... *H01P 7/06* (2013.01); *H01P 1/207* (2013.01); *H01P 1/2084* (2013.01)

(58) Field of Classification Search
CPC .... H01P 7/105; H01P 7/10; H01P 7/06; H01P 1/207; H01P 1/2084; H01P 1/2086
(Continued)

(56) References Cited

U.S. PATENT DOCUMENTS 7,283,022 B2 10/2007 Andreasson et al.
2003/0043000 A1 3/2003 Karhu
(Continued)

FOREIGN PATENT DOCUMENTS

CN 1269914 A 10/2000
CN 102324602 A 1/2012
(Continued)

OTHER PUBLICATIONS

Wang et al., "Design of a tri-band bandpass filter based on a multiple-mode resonator," Electronic Components and Materials, May 2017, 36(5):6 pages.
(Continued)

*Primary Examiner* — Stephen E. Jones
(74) *Attorney, Agent, or Firm* — Fish & Richardson P.C.

(57) ABSTRACT

Embodiments of this application provide a dual-mode resonator, a filter, and a radio frequency unit. The dual-mode resonator includes a cavity and a dual-mode dielectric body coupled to an inner surface of the cavity. The dual-mode dielectric body includes a central part and four components that protrude from the central part, where the four components are disposed opposite to each other in pair and are in a cross shape. A first coupling groove and a second coupling groove are provided on the central part, where an extension direction of the first coupling groove is between two adjacent components, and an extension direction of the second coupling groove is between the other two adjacent components. The widths and/or the depths of the first and the second coupling grooves are different, and the extension direction of the first coupling groove and the extension direction of the second coupling groove are at a preset angle.

19 Claims, 3 Drawing Sheets

(58) Field of Classification Search
USPC ..... 333/219.1, 208, 202, 212, 209
See application file for complete search history.

(56) References Cited

U.S. PATENT DOCUMENTS

| | | | |
|---|---|---|---|
| 2006/0139127 | A1 | 6/2006 | Wada et al. |
| 2016/0301123 | A1 | 10/2016 | Solomon et al. |
| 2017/0263996 | A1 | 9/2017 | Karhu |

FOREIGN PATENT DOCUMENTS

| | | | |
|---|---|---|---|
| CN | 102593561 | A | 7/2012 |
| CN | 202839929 | U | 3/2013 |
| CN | 105161814 | A | 12/2015 |
| CN | 205141103 | U | 4/2016 |
| CN | 107181027 | A | 9/2017 |
| CN | 107210508 | A | 9/2017 |
| JP | H08222917 | A | 8/1996 |
| JP | 2016225964 | A | 12/2016 |
| WO | 2017215739 | A1 | 12/2017 |

OTHER PUBLICATIONS

Office Action in Chinese Application No. 201810241048.X, dated Jun. 16, 2021, 4 pages.
Office Action issued in Chinese Application No. 201810241048.X dated Oct. 26, 2020, 29 pages (with English translation).
PCT International Search Report and Written Opinion issued in International Application No. PCT/CN2019/079317 dated May 28, 2019, 17 pages (with English translation).
Extended European Search Report issued in European Application No. 19772602.9 dated Mar. 30, 2021, 9 pages.

DUAL-MODE RESONATOR, FILTER, AND RADIO FREQUENCY UNIT

CROSS-REFERENCE TO RELATED APPLICATIONS

This application is a continuation of International Application No. PCT/CN2019/079317, filed on Mar. 22, 2019, which claims priority to Chinese Patent Application No. 201810241048.X, filed on Mar. 22, 2018. The disclosures of the aforementioned applications are hereby incorporated by reference in their entireties.

TECHNICAL FIELD

Embodiments of this application relate to communications technologies, and in particular, to a dual-mode resonator, a filter, and a radio frequency unit.

BACKGROUND

A resonator is a basic component of a filter in a communications system and is configured to provide, when a signal is input to the filter, a specified frequency response. A dual-mode resonator is a specific type of resonator. The dual-mode resonator has attracted much attention in the industry due to advantages such as miniaturization, a high Q/V (Q represents a quality factor, and a corresponding full name is quality; and V represents a volume, and a corresponding full name is volume) ratio, and high power.

However, an existing dual-mode resonator still has many disadvantages. For example, mutual coupling between dual modes is relatively complex, and it is difficult to independently control positive and negative coupling. Therefore, how to independently control positive and negative coupling of the dual-mode resonator is a difficulty in designing a dual-mode resonator.

SUMMARY

Embodiments of this application provide a dual-mode resonator, a filter, and a radio frequency unit, to independently control positive and negative coupling of the dual-mode resonator.

According to a first aspect, an embodiment of this application provides a dual-mode resonator, including: a cavity and a dual-mode dielectric body coupled to an inner surface of the cavity, where the dual-mode dielectric body includes a central part and four components that protrude from the central part, the four components are disposed opposite to each other in pair and are in a cross shape, and a first coupling groove and a second coupling groove are provided on the central part, where an extension direction of the first coupling groove is between two adjacent components, an extension direction of the second coupling groove is between the other two adjacent components, widths and/or depths of the first coupling groove and the second coupling groove are different, and the extension direction of the first coupling groove and the extension direction of the second coupling groove are at a preset angle.

The dual-mode dielectric body of the dual-mode resonator includes the central part and the four components that protrude from the central part, the four components are disposed opposite to each other in pair and are in the cross shape, for example, in the shape of "X" or a cross of lines perpendicular to each other, and the first coupling groove and the second coupling groove are provided on the central part, where the extension direction of the first coupling groove is between the two adjacent components, the extension direction of the second coupling groove is between the other two adjacent components, the widths and/or the depths of the first coupling groove and the second coupling groove are different, and the extension direction of the first coupling groove and the extension direction of the second coupling groove are at the preset angle. For example, the first coupling groove is provided between a horizontally disposed component and a vertically disposed component among the four components disposed in the shape of the cross of the lines perpendicular to each other, and is in the shape of "/"; and the second coupling groove is also provided between a horizontally disposed component and a vertically disposed component among the four components disposed in the shape of the cross of the lines perpendicular to each other, and is in the shape of "\". The first coupling groove and the second coupling groove are provided, so that there can be a relatively large coupling coefficient between two resonance modes of the dual-mode resonator, and therefore, the dual-mode resonator has relatively wide bandwidth. In addition, the widths and/or the depths of the first coupling groove and the second coupling groove are different, so that positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

In a possible implementation, when the depth of the first coupling groove is equal to the depth of the second coupling groove, and the width of the first coupling groove is greater than the width of the second coupling groove, the two resonance modes of the dual-mode resonator are positively coupled. Alternatively, when the width of the first coupling groove is equal to the width of the second coupling groove, and the depth of the first coupling groove is greater than the depth of the second coupling groove, the two resonance modes of the dual-mode resonator are positively coupled.

In a possible implementation, when the depth of the first coupling groove is equal to the depth of the second coupling groove, and the width of the first coupling groove is less than the width of the second coupling groove, the two resonance modes of the dual-mode resonator are negatively coupled. Alternatively, when the width of the first coupling groove is equal to the width of the second coupling groove, and the depth of the first coupling groove is greater than the depth of the second coupling groove, the two resonance modes of the dual-mode resonator are negatively coupled.

In a possible implementation, both the first coupling groove and the second coupling groove are long-strip-shaped grooves; both the first coupling groove and the second coupling groove are in a shape deformed from the long-strip-shape; one of the first coupling groove and the second coupling groove is a long-strip-shaped groove, and the other one is in a shape deformed from the long-strip-shape; or the first coupling groove and the second coupling groove are in other shapes.

In a possible implementation, the first coupling groove and the second coupling groove are perpendicular to each other.

In a possible implementation, the dual-mode resonator may further include a first tuning mechanical part, and the first tuning mechanical part is adjacent to the first coupling groove or the second coupling groove. When the first tuning mechanical part is adjacent to the first coupling groove, coupling may be weakened by using the first tuning mechanical part. When the first tuning mechanical part is adjacent to the second coupling groove, coupling may be strengthened by using the first tuning mechanical part. Therefore, a coupling coefficient of the two resonance modes of the dual-mode resonator is conveniently tuned in a large range. For example, the first tuning mechanical part may specifically be a tuning screw or another plastic or ceramic member. However, this embodiment of this application is not limited thereto.

In a possible implementation, opening grooves are provided on respective outer end portions of two adjacent components, a second tuning mechanical part is disposed in one opening groove, and a third tuning mechanical part is disposed in the other opening groove. The coupling coefficient of the two resonance modes of the dual-mode resonator can be tuned in a large range by using the second tuning mechanical part and the third tuning mechanical part.

For example, the second tuning mechanical part and the third tuning mechanical part may also specifically be tuning screws or other plastic or ceramic members. However, this embodiment of this application is not limited thereto. In addition, materials of the second tuning mechanical part and the third tuning mechanical part may be the same, or materials of the second tuning mechanical part and the third tuning mechanical part may be different.

In a possible implementation, heights of the two adjacent components provided with the opening grooves are lower than heights of other components. In this way, when the dual-mode dielectric body is connected to the inner surface of the cavity through welding or the like, fluid such as solder can be prevented from flowing to the second tuning mechanical part and/or the third tuning mechanical part, so that heights/a height of the second tuning mechanical part and/or the third tuning mechanical part can be adjusted (for example, adjusted through rotating). Therefore, it is ensured that the coupling coefficient of the two resonance modes of the dual-mode resonator is tuned in a large range by using the second tuning mechanical part and the third tuning mechanical part.

In a possible implementation, the dual-mode resonator further includes a fourth tuning mechanical part, where the fourth tuning mechanical part is disposed at the bottom of the dual-mode dielectric body. Fourth tuning mechanical parts of different sizes are disposed at the bottom of the dual-mode dielectric body, so that harmonics of the dual-mode resonator can be tuned in a large range when a main mode of the dual-mode resonator is slightly affected. Similarly, the fourth tuning mechanical part may specifically be a tuning screw or another plastic or ceramic member. However, this embodiment of this application is not limited thereto. When the dual-mode resonator includes the first tuning mechanical part, the second tuning mechanical part, the third tuning mechanical part, and the fourth tuning mechanical part altogether, respective materials of the first tuning mechanical part, the second tuning mechanical part, the third tuning mechanical part, and the fourth tuning mechanical part may be the same or different. For example, the first tuning mechanical part is a metal screw, and the second tuning mechanical part, the third tuning mechanical part, and the fourth tuning mechanical part are ceramic screws.

In addition, shapes and sizes of the first tuning mechanical part, the second tuning mechanical part, the third tuning mechanical part, and the fourth tuning mechanical part may be designed based on an actual requirement. For example, the shape may be a circle or a square, and for a size that describes cooperation between the dual-mode dielectric body and each mechanical part, a distance from the dual-mode dielectric body to each mechanical part may be 1.5-2 mm.

In a possible implementation, the dual-mode dielectric body is connected to the inner surface of the cavity by using a cover plate of a secondary body. In this way, a connecting stress between the dual-mode dielectric body and the cavity can be reduced, and reliability of the dual-mode resonator can be improved. The cover plate may be a metal sheet such as an iron sheet or a copper sheet, a printed circuit board, or the like. This is not limited in this embodiment of this application.

In a possible implementation, there is one contact surface between the dual-mode dielectric body and the cover plate; there are two contact surfaces between the dual-mode dielectric body and the cover plate; there are three contact surfaces between the dual-mode dielectric body and the cover plate; there are four contact surfaces between the dual-mode dielectric body and the cover plate; or there may be another quantity of contact surfaces between the dual-mode dielectric body and the cover plate. In this case, it may be understood that there is one cover plate.

In a possible implementation, there are a plurality of cover plates.

In a possible implementation, an additional groove is provided on a periphery of the cover plate.

According to a second aspect, an embodiment of this application provides a dual-mode resonator, including: a cavity and a dual-mode dielectric body coupled to an inner surface of the cavity, where the dual-mode dielectric body includes a central part and four components that protrude from the central part, and the four components are disposed opposite to each other in pair and are in a cross shape; and opening grooves are provided on respective outer end portions of two adjacent components, a second tuning mechanical part is disposed in one opening groove, and a third tuning mechanical part is disposed in the other opening groove.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that a coupling coefficient of two resonance modes of the dual-mode resonator can be tuned in a large range by adjusting heights of the second tuning mechanical part and the third tuning mechanical part.

For example, the second tuning mechanical part and the third tuning mechanical part may specifically be tuning screws or other plastic or ceramic members. However, this embodiment of this application is not limited thereto. In addition, materials of the second tuning mechanical part and the third tuning mechanical part may be the same, or materials of the second tuning mechanical part and the third tuning mechanical part may be different.

In a possible implementation, heights of the two adjacent components provided with the opening grooves are lower than heights of other components. In this way, when the dual-mode dielectric body is connected to the inner surface of the cavity through welding or the like, fluid such as solder can be prevented from flowing to the second tuning mechanical part and/or the third tuning mechanical part, so that heights/a height of the second tuning mechanical part and/or the third tuning mechanical part can be adjusted (for example, adjusted through rotating). Therefore, it is ensured that the coupling coefficient of the two resonance modes of the dual-mode resonator is tuned in a large range by using the second tuning mechanical part and the third tuning mechanical part.

In a possible implementation, a first coupling groove and a second coupling groove are provided on the central part, an extension direction of the first coupling groove is between two adjacent components, and an extension direction of the second coupling groove is between the other two adjacent components. Widths and/or depths of the first coupling groove and the second coupling groove are different, and the extension direction of the first coupling groove and the extension direction of the second coupling groove are at a preset angle.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that the coupling coefficient of the two resonance modes of the dual-mode resonator can be tuned in a large range by adjusting the heights of the second tuning mechanical part and the third tuning mechanical part. In addition, the first coupling groove and the second coupling groove are provided on the central part, where the extension direction of the first coupling groove is between the two adjacent components, the extension direction of the second coupling groove is between the other two adjacent components, the widths and/or the depths of the first coupling groove and the second coupling groove are different, and the extension direction of the first coupling groove and the extension direction of the second coupling groove are at the preset angle. For example, the first coupling groove is provided between a horizontally disposed component and a vertically disposed component among the four components disposed in the shape of the cross of the lines perpendicular to each other, and is in the shape of "/"; and the second coupling groove is also provided between a horizontally disposed component and a vertically disposed component among the four components disposed in the shape of the cross of the lines perpendicular to each other, and is in the shape of "\". The first coupling groove and the second coupling groove are provided, so that there can be a relatively large coupling coefficient between the two resonance modes of the dual-mode resonator, and therefore, the dual-mode resonator has relatively wide bandwidth. In addition, the widths and/or the depths of the first coupling groove and the second coupling groove are different, so that positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

In a possible implementation, when the depth of the first coupling groove is equal to the depth of the second coupling groove, and the width of the first coupling groove is greater than the width of the second coupling groove, the two resonance modes of the dual-mode resonator are positively coupled. Alternatively, when the width of the first coupling groove is equal to the width of the second coupling groove, and the depth of the first coupling groove is greater than the depth of the second coupling groove, the two resonance modes of the dual-mode resonator are positively coupled.

In a possible implementation, when the depth of the first coupling groove is equal to the depth of the second coupling groove, and the width of the first coupling groove is less than the width of the second coupling groove, the two resonance modes of the dual-mode resonator are negatively coupled. Alternatively, when the width of the first coupling groove is equal to the width of the second coupling groove, and the depth of the first coupling groove is greater than the depth of the second coupling groove, the two resonance modes of the dual-mode resonator are negatively coupled.

In a possible implementation, both the first coupling groove and the second coupling groove are long-strip-shaped grooves; both the first coupling groove and the second coupling groove are in a shape deformed from the long-strip-shape; one of the first coupling groove and the second coupling groove is a long-strip-shaped groove, and the other one is in a shape deformed from the long-strip-shape; or the first coupling groove and the second coupling groove are in other shapes.

In a possible implementation, the first coupling groove and the second coupling groove are perpendicular to each other.

In a possible implementation, the dual-mode resonator may further include a first tuning mechanical part, and the first tuning mechanical part is adjacent to the first coupling groove or the second coupling groove. When the first tuning mechanical part is adjacent to the first coupling groove, coupling may be weakened by using the first tuning mechanical part. When the first tuning mechanical part is adjacent to the second coupling groove, coupling may be strengthened by using the first tuning mechanical part. Therefore, the coupling coefficient of the two resonance modes of the dual-mode resonator is conveniently tuned in a large range. For example, the first tuning mechanical part may specifically be a tuning screw or another plastic or ceramic member. However, this embodiment of this application is not limited thereto.

In a possible implementation, the dual-mode resonator further includes a fourth tuning mechanical part, where the fourth tuning mechanical part is disposed at the bottom of the dual-mode dielectric body. Fourth tuning mechanical parts of different sizes are disposed at the bottom of the dual-mode dielectric body, so that harmonics of the dual-mode resonator can be tuned in a large range when a main mode of the dual-mode resonator is slightly affected. Similarly, the fourth tuning mechanical part may specifically be a tuning screw or another plastic or ceramic member. However, this embodiment of this application is not limited thereto. When the dual-mode resonator includes the first tuning mechanical part, the second tuning mechanical part, the third tuning mechanical part, and the fourth tuning mechanical part altogether, respective materials of the first tuning mechanical part, the second tuning mechanical part, the third tuning mechanical part, and the fourth tuning mechanical part may be the same or different. For example, the first tuning mechanical part is a metal screw, and the second tuning mechanical part, the third tuning mechanical part, and the fourth tuning mechanical part are ceramic screws.

In addition, shapes and sizes of the first tuning mechanical part, the second tuning mechanical part, the third tuning mechanical part, and the fourth tuning mechanical part may be designed based on an actual requirement. For example, the shape may be a circle or a square, and for a size that describes cooperation between the dual-mode dielectric body and each mechanical part, a distance from the dual-mode dielectric body to each mechanical part may be 1.5-2 mm.

In a possible implementation, the dual-mode dielectric body is connected to the inner surface of the cavity by using a cover plate of a secondary body. In this way, a connecting stress between the dual-mode dielectric body and the cavity can be reduced, and reliability of the dual-mode resonator can be improved. The cover plate may be a metal sheet such as an iron sheet or a copper sheet, a printed circuit board, or the like. This is not limited in this embodiment of this application.

In a possible implementation, there is one contact surface between the dual-mode dielectric body and the cover plate; there are two contact surfaces between the dual-mode dielectric body and the cover plate; there are three contact surfaces between the dual-mode dielectric body and the cover plate; there are four contact surfaces between the dual-mode dielectric body and the cover plate; or there may be another quantity of contact surfaces between the dual-mode dielectric body and the cover plate.

In a possible implementation, there are a plurality of cover plates.

In a possible implementation, an additional groove is provided on a periphery of the cover plate.

According to a third aspect, an embodiment of this application provides a dual-mode resonator, including: a cavity, a dual-mode dielectric body coupled to an inner surface of the cavity, and a fourth tuning mechanical part disposed at the bottom of the dual-mode dielectric body, where the dual-mode dielectric body includes a central part and four components that protrude from the central part, and the four components are disposed opposite to each other in pair and are in a cross shape. Fourth tuning mechanical parts of different sizes are disposed at the bottom of the dual-mode dielectric body, so that harmonics of the dual-mode resonator can be tuned in a large range when a main mode of the dual-mode resonator is slightly affected.

The fourth tuning mechanical part may specifically be a tuning screw or another plastic or ceramic member. However, this embodiment of this application is not limited thereto.

In a possible implementation, opening grooves are provided on respective outer end portions of two adjacent components, a second tuning mechanical part is disposed in one opening groove, and a third tuning mechanical part is disposed in the other opening groove.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that a coupling coefficient of two resonance modes of the dual-mode resonator can be tuned in a large range by adjusting heights of the second tuning mechanical part and the third tuning mechanical part.

For example, the second tuning mechanical part and the third tuning mechanical part may also specifically be tuning screws or other plastic or ceramic members. However, this embodiment of this application is not limited thereto. In addition, materials of the second tuning mechanical part and the third tuning mechanical part may be the same, or materials of the second tuning mechanical part and the third tuning mechanical part may be different.

In a possible implementation, heights of the two adjacent components provided with the opening grooves are lower than heights of other components. In this way, when the dual-mode dielectric body is connected to the inner surface of the cavity through welding or the like, fluid such as solder can be prevented from flowing to the second tuning mechanical part and/or the third tuning mechanical part, so that heights/a height of the second tuning mechanical part and/or the third tuning mechanical part can be adjusted (for example, adjusted through rotating). Therefore, it is ensured that the coupling coefficient of the two resonance modes of the dual-mode resonator is tuned in a large range by using the second tuning mechanical part and the third tuning mechanical part.

In a possible implementation, a first coupling groove and a second coupling groove are provided on the central part, an extension direction of the first coupling groove is between two adjacent components, and an extension direction of the second coupling groove is between the other two adjacent components. Widths and/or depths of the first coupling groove and the second coupling groove are different, and the extension direction of the first coupling groove and the extension direction of the second coupling groove are at a preset angle.

The dual-mode resonator includes: the cavity, the dual-mode dielectric body coupled to the inner surface of the cavity, and the fourth tuning mechanical part disposed at the bottom of the dual-mode dielectric body. The dual-mode dielectric body includes the central part and the four components that protrude from the central part, and the four components are disposed opposite to each other in pair and are in a cross shape, for example, in the shape of "X" or a cross of lines perpendicular to each other. Fourth tuning mechanical parts of different sizes are disposed at the bottom of the dual-mode dielectric body, so that the harmonics of the dual-mode resonator can be tuned in a large range when the main mode of the dual-mode resonator is slightly affected. In addition, the first coupling groove and the second coupling groove are provided on the central part, where the extension direction of the first coupling groove is between the two adjacent components, the extension direction of the second coupling groove is between the other two adjacent components, the widths and/or the depths of the first coupling groove and the second coupling groove are different, and the extension direction of the first coupling groove and the extension direction of the second coupling groove are at the preset angle. For example, the first coupling groove is provided between a horizontally disposed component and a vertically disposed component among the four components disposed in the shape of the cross of the lines perpendicular to each other, and is in the shape of "/"; and the second coupling groove is also provided between a horizontally disposed component and a vertically disposed component among the four components disposed in the shape of the cross of the lines perpendicular to each other, and is in the shape of "\". The first coupling groove and the second coupling groove are provided, so that there can be a relatively large coupling coefficient between the two resonance modes of the dual-mode resonator, and therefore, the dual-mode resonator has relatively wide bandwidth. In addition, the widths and/or the depths of the first coupling groove and the second coupling groove are different, so that positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

In a possible implementation, when the depth of the first coupling groove is equal to the depth of the second coupling groove, and the width of the first coupling groove is greater than the width of the second coupling groove, the two resonance modes of the dual-mode resonator are positively coupled. Alternatively, when the width of the first coupling groove is equal to the width of the second coupling groove, and the depth of the first coupling groove is greater than the depth of the second coupling groove, the two resonance modes of the dual-mode resonator are positively coupled.

In a possible implementation, when the depth of the first coupling groove is equal to the depth of the second coupling groove, and the width of the first coupling groove is less than the width of the second coupling groove, the two resonance modes of the dual-mode resonator are negatively coupled. Alternatively, when the width of the first coupling groove is equal to the width of the second coupling groove, and the depth of the first coupling groove is greater than the depth of the second coupling groove, the two resonance modes of the dual-mode resonator are negatively coupled.

In a possible implementation, both the first coupling groove and the second coupling groove are long-strip-shaped grooves; both the first coupling groove and the second coupling groove are in a shape deformed from the long-strip-shape; one of the first coupling groove and the second coupling groove is a long-strip-shaped groove, and the other one is in a shape deformed from the long-strip-shape; or the first coupling groove and the second coupling groove are in other shapes.

In a possible implementation, the first coupling groove and the second coupling groove are perpendicular to each other.

In a possible implementation, the dual-mode resonator may further include a first tuning mechanical part, and the first tuning mechanical part is adjacent to the first coupling groove or the second coupling groove. When the first tuning mechanical part is adjacent to the first coupling groove, coupling may be weakened by using the first tuning mechanical part. When the first tuning mechanical part is adjacent to the second coupling groove, coupling may be strengthened by using the first tuning mechanical part. Therefore, the coupling coefficient of the two resonance modes of the dual-mode resonator is conveniently tuned in a large range. For example, the first tuning mechanical part may specifically be a tuning screw or another plastic or ceramic member. However, this embodiment of this application is not limited thereto.

When the dual-mode resonator includes the first tuning mechanical part, the second tuning mechanical part, the third tuning mechanical part, and the fourth tuning mechanical part altogether, respective materials of the first tuning mechanical part, the second tuning mechanical part, the third tuning mechanical part, and the fourth tuning mechanical part may be the same or different. For example, the first tuning mechanical part is a metal screw, and the second tuning mechanical part, the third tuning mechanical part, and the fourth tuning mechanical part are ceramic screws. In addition, shapes and sizes of the first tuning mechanical part, the second tuning mechanical part, the third tuning mechanical part, and the fourth tuning mechanical part may be designed based on an actual requirement. For example, the shape may be a circle or a square, and for a size that describes cooperation between the dual-mode dielectric body and each mechanical part, a distance from the dual-mode dielectric body to each mechanical part may be 1.5-2 mm.

In a possible implementation, the dual-mode dielectric body is connected to the inner surface of the cavity by using a cover plate of a secondary body. In this way, a connecting stress between the dual-mode dielectric body and the cavity can be reduced, and reliability of the dual-mode resonator can be improved. The cover plate may be a metal sheet such as an iron sheet or a copper sheet, a printed circuit board, or the like. This is not limited in this embodiment of this application.

In a possible implementation, there is one contact surface between the dual-mode dielectric body and the cover plate; there are two contact surfaces between the dual-mode dielectric body and the cover plate; there are three contact surfaces between the dual-mode dielectric body and the cover plate; there are four contact surfaces between the dual-mode dielectric body and the cover plate; or there may be another quantity of contact surfaces between the dual-mode dielectric body and the cover plate.

In a possible implementation, there are a plurality of cover plates.

In a possible implementation, an additional groove is provided on a periphery of the cover plate.

According to a fourth aspect, an embodiment of this application provides a filter, where the filter includes at least one dual-mode resonator according to any one of the foregoing implementations.

According to a fifth aspect, an embodiment of this application provides a radio frequency unit, where the radio frequency unit includes at least one filter. The filter includes at least one dual-mode resonator according to any one of the foregoing implementations.

The foregoing and other aspects of this application are clearer and easier to understand in descriptions of the following (a plurality of) embodiments.

DESCRIPTION OF EMBODIMENTS

Figure 1A:
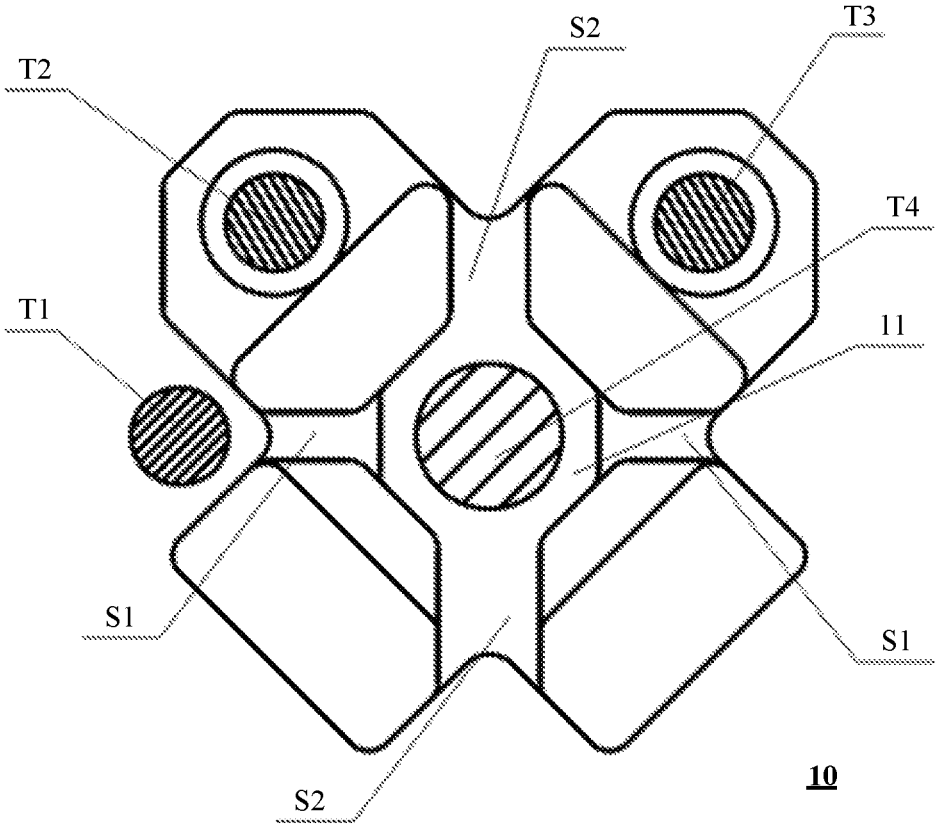
FIG. 1A and FIG. 1B are both top views of a dual-mode resonator according to an embodiment of this application.

The following describes embodiments of this application in detail. Examples of the embodiments are shown in the accompanying drawings. Same or similar reference signs are always used to represent same or similar elements or elements having same or similar functions. The embodiments described below with reference to the accompanying drawings are examples, and are merely used to explain this application, but cannot be understood as a limitation on this application.

In the descriptions of the embodiments of this application, it should be understood that direction or location relationships indicated by terms “upper”, “on”, “below”, “front”, “rear”, “vertical”, “horizontal, “bottom”, “inner”, “outer”, or the like are direction or location relationships shown based on the accompanying drawings, and are merely intended to conveniently describe this application and simplify the description, but are not intended to indicate or imply that an apparatus or an element needs to have a particular direction and needs to be constructed and operated in the particular direction. Therefore, such terms cannot be understood as a limitation on the embodiments of this application. In the descriptions of the embodiments of this application, unless otherwise specifically specified, "a plurality of" means two or more.

In the descriptions of the embodiments of this application, it should be noted that, unless otherwise clearly specified and limited, a term "connect" should be understood in a broad sense. For example, the term may be used for a fixed connection, a connection through intermediate media, an internal connection between two elements, or an interaction relationship between two elements. Persons of ordinary skill in the art may understand a specific meaning of the term in the embodiments of this application based on specific cases.

In the specification, claims, and accompanying drawings of the embodiments of this application, terms "first", "second", "third", "fourth", and so on are intended to distinguish between similar objects but do not necessarily indicate a specific order or sequence. It should be understood that data termed in such a way are interchangeable in proper circumstances so that the embodiments of this application described herein can be implemented in orders except orders illustrated or described herein. Moreover, terms "include", "contain" and any other variants mean to cover the non-exclusive inclusion, for example, a process, method, system, product, or device that includes a list of steps or units is not necessarily limited to those expressly listed steps or units, but may include other steps or units not expressly listed or inherent to such a process, method, system, product, or device.

The following first explains some terms in the embodiments of this application.

A resonator is a basic component of a filter in a communications system. A dual-mode resonator is a resonator having two resonance modes, that is, the resonator can implement resonance at two frequencies.

Coupling refers to energy exchange between the two resonance modes of the dual-mode resonator, so that frequency expansion of a resonance mode can be implemented. To be specific, stronger coupling indicates that wider bandwidth can be implemented.

A filter is a passive device in a communication radio frequency channel, namely, a radio frequency component that is in a remote radio unit and that is connected to an antenna. Required frequencies in a passband may be allowed to pass through the filter with low loss. The filter may greatly weaken frequency composition that is not required and that is out of the passband, to avoid interference in other parts of a system.

A harmonic is an additional resonance mode that is outside a main channel and that is caused by frequency multiplication of the resonator, resonance of connected resonance modes, and the like.

The following describes, by using specific embodiments, a dual-mode resonator provided in this application. The dual-mode resonator may be applied to, but is not limited to, an implementation scenario in which the dual-mode resonator and a single-mode resonator that are in a radio frequency filter are coupled to each other.

Figure 1B:
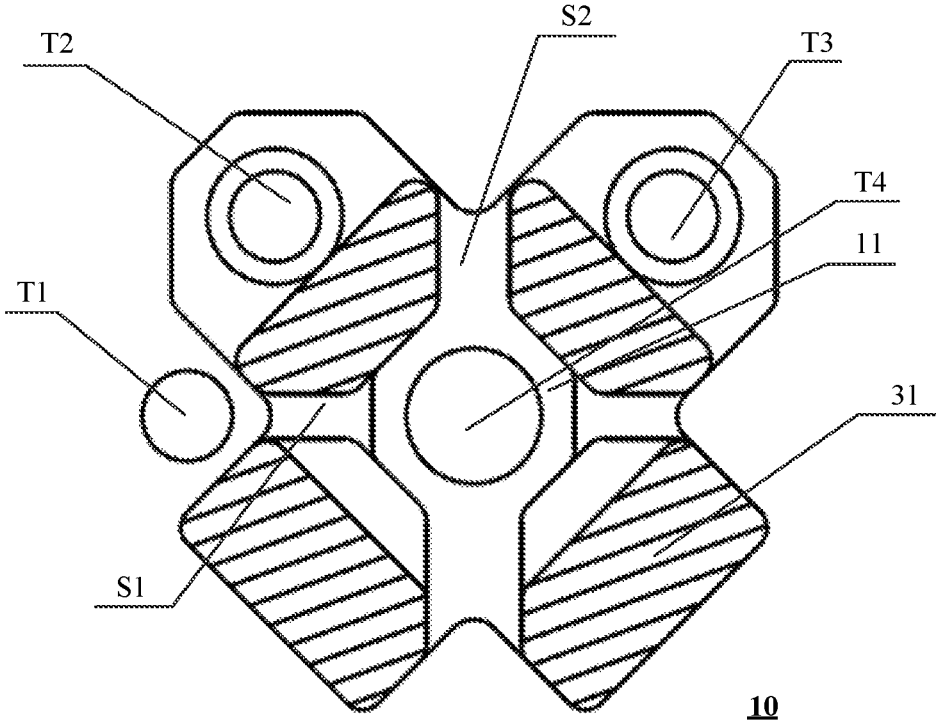

FIG. 1A and FIG. 1B are both top views of a dual-mode resonator according to an embodiment of this application. Referring to FIG. 1A and FIG. 1B, a dual-mode resonator 10 includes a cavity (not shown) and a dual-mode dielectric body 11 coupled to an inner surface of the cavity. The dual-mode dielectric body 11 includes a central part and four components that protrude from the central part, and the four components are disposed opposite to each other in pair and are in a cross shape. A first coupling groove S1 and a second coupling groove S2 are provided on the central part, an extension direction of the first coupling groove S1 is between two adjacent components, and an extension direction of the second coupling groove S2 is between the other two adjacent components. The widths and/or the depths of the first coupling groove S1 and the second coupling groove S2 are different, and the extension direction of the first coupling groove S1 and the extension direction of the second coupling groove S2 are at a preset angle.

Optionally, a low-loss dielectric material is used for the dual-mode dielectric body 11. For example, a material of the dual-mode dielectric body 11 is a ceramic material, a plastic material, or a mixed material, but this embodiment of this application is not limited thereto. In some embodiments, the dual-mode dielectric body 11 may be formed through pressing, so that the dual-mode dielectric body 11 is easy to manufacture. For example, the first coupling groove S1 and the second coupling groove S2 are formed through pressing. Alternatively, a structure of the dual-mode dielectric body 11 may be formed through mechanical processing. Alternatively, a structure of the dual-mode dielectric body 11 is formed by combining a mechanical processing manner and a pressing manner.

The dual-mode dielectric body 11 is connected to the inner surface of the cavity. Optionally, the cavity is formed by a conductive material such as metal. The dual-mode dielectric body 11 may be connected to the cavity by using a low-loss dielectric material; the dual-mode dielectric body 11 may be connected to the cavity by using a low-loss adhesive or low-loss solder; or the dual-mode dielectric body 11 may be connected to the cavity in another manner.

For the four components that protrude from the central part of the dual-mode dielectric body 11, the four components are disposed opposite to each other in pair and are in the cross shape. In this way, a resonance mode can be excited by using every two components disposed opposite to each other. For example, the four components are in the shape of "X" or a cross of lines perpendicular to each other.

The extension direction of the first coupling groove S1 is between the two adjacent components, and the extension direction of the second coupling groove S2 is between the other two adjacent components. The extension direction of the first coupling groove S1 and the extension direction of the second coupling groove S2 are at the preset angle. In one understanding, referring to FIG. 1A and FIG. 1B, when the dual-mode dielectric body 11 is placed as shown in the figures, the first coupling groove S1 is provided horizontally, and the second coupling groove S2 is provided vertically. In another understanding, when the dual-mode dielectric body 11 is placed as a cross of lines perpendicular to each other, the first coupling groove S1 is provided between a horizontally disposed component and a vertically disposed component among the four components disposed in the shape of the cross of the lines perpendicular to each other, and is in the shape of "/"; and the second coupling groove S2 is also provided between a horizontally disposed component and a vertically disposed component among the four components disposed in the cross of the lines perpendicular to each other, and is in the shape of "\". The foregoing two understandings are essentially the same, and are both used to explain positions of the first coupling groove S1 and the second coupling groove S2 on the central part. An only difference between the two understandings is that placement directions of dual-mode dielectric bodies 11 are different.

It should be noted that the first coupling groove S1 and the second coupling groove S2 are provided, so that there can be a relatively large coupling coefficient between two resonance modes of the dual-mode resonator 10, and therefore, the dual-mode resonator 10 has relatively wide bandwidth. In addition, positive and negative coupling between the two resonance modes of the dual-mode resonator 10 can be implemented by adjusting the widths and/or the depths of the first coupling groove S1 and the second coupling groove S2.

When the depth of the first coupling groove S1 is equal to the depth of the second coupling groove S2, and the width of the first coupling groove S1 is greater than the width of the second coupling groove S2, the two resonance modes of the dual-mode resonator 10 are positively coupled. Alternatively, when the width of the first coupling groove S1 is equal to the width of the second coupling groove S2, and the depth of the first coupling groove S1 is greater than the depth of the second coupling groove S2, the two resonance modes of the dual-mode resonator 10 are positively coupled.

When the depth of the first coupling groove S1 is equal to the depth of the second coupling groove S2, and the width of the first coupling groove S1 is less than the width of the second coupling groove S2, the two resonance modes of the dual-mode resonator 10 are negatively coupled. Alternatively, when the width of the first coupling groove S1 is equal to the width of the second coupling groove S2, and the depth of the first coupling groove S1 is greater than the depth of the second coupling groove S2, the two resonance modes of the dual-mode resonator 10 are negatively coupled.

When the depth of the first coupling groove S1 is greater than the depth of the second coupling groove S2, to achieve a balance between performance of the first coupling groove S1 and performance of the second coupling groove S2, the width of the first coupling groove S1 may be adjusted to be less than the width of the second coupling groove S2. A specific adjusted width is experimented in actual application, and is not limited in this embodiment of this application. Alternatively, when the width of the first coupling groove S1 is greater than the width of the second coupling groove S2, to achieve a balance between performance of the first coupling groove S1 and performance of the second coupling groove S2, the depth of the first coupling groove S1 may be adjusted to be less than the depth of the second coupling groove S2. A specific adjusted depth is experimented in actual application, and is not limited in this embodiment of this application.

Similarly, when the depth of the first coupling groove S1 is less than the depth of the second coupling groove S2, to achieve a balance between the performance of the first coupling groove S1 and the performance of the second coupling groove S2, the width of the first coupling groove S1 may be adjusted to be greater than the width of the second coupling groove S2. A specific adjusted width is experimented in actual application, and is not limited in this embodiment of this application. Alternatively, when the width of the first coupling groove S1 is less than the width of the second coupling groove S2, to achieve a balance between the performance of the first coupling groove S1 and the performance of the second coupling groove S2, the depth of the first coupling groove S1 may be adjusted to be greater than the depth of the second coupling groove S2. A specific adjusted depth is experimented in actual application, and is not limited in this embodiment of this application.

In some embodiments, the first coupling groove S1 and the second coupling groove S2 are perpendicular to each other. In some other embodiments, the preset angle is not 90 degrees, and may be specifically adjusted based on an actual requirement.

For input and output of the dual-mode resonator 10, refer to the related art. Details are not described herein again.

In this embodiment, the dual-mode dielectric body of the dual-mode resonator includes the central part and the four components that protrude from the central part, where the four components are disposed opposite to each other in pair and are in the cross shape, the first coupling groove and the second coupling groove are provided on the central part, and the extension direction of the first coupling groove is between the two adjacent components, where the extension direction of the second coupling groove is between the other two adjacent components, the widths and/or the depths of the first coupling groove and the second coupling groove are different, and the extension direction of the first coupling groove and the extension direction of the second coupling groove are at the preset angle. The first coupling groove and the second coupling groove are provided, so that there can be the relatively large coupling coefficient between the two resonance modes of the dual-mode resonator, and therefore, the dual-mode resonator has the relatively wide bandwidth. In addition, the widths and/or the depths of the first coupling groove and the second coupling groove are different, so that the positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

Further, the positive and negative coupling of the dual-mode resonator are independently controlled, so that a required transmission zero can be conveniently formed subsequently. For example, the transmission zero is formed through cooperation between the dual-mode resonator and another dual-mode resonator, thereby improving design flexibility.

Based on the foregoing embodiments, optionally, both the first coupling groove S1 and the second coupling groove S2 are long-strip-shaped grooves; both the first coupling groove S1 and the second coupling groove S2 are in a shape deformed from the long-strip-shape; one of the first coupling groove S1 and the second coupling groove S2 is a long-strip-shaped groove, and the other one is in a shape deformed from the long-strip-shape; or the first coupling groove S1 and the second coupling groove S2 are in other shapes.

Still referring to FIG. 1A and FIG. 1B, the dual-mode resonator 10 may further include a first tuning mechanical part T1. The first tuning mechanical part T1 is adjacent to the first coupling groove S1 or the second coupling groove S2. Herein, for example, the first tuning mechanical part T1 is adjacent to the first coupling groove S1. For example, the first tuning mechanical part T1 may specifically be a tuning screw or another plastic or ceramic member. However, this embodiment of this application is not limited thereto.

When the first tuning mechanical part is adjacent to the first coupling groove, coupling between the two resonance modes may be weakened by using the first tuning mechanical part. When the first tuning mechanical part is adjacent to the second coupling groove, coupling between the two resonance modes may be strengthened by using the first tuning mechanical part. Therefore, the coupling coefficient of the two resonance modes of the dual-mode resonator is conveniently tuned in a large range.

It should be noted that a closer distance between the first tuning mechanical part and the first coupling groove or the second coupling groove indicates a better effect on weakening or strengthening the coupling between the two resonance modes by using the first tuning mechanical part. On the contrary, a further distance between the first tuning mechanical part and the first coupling groove or the second coupling groove indicates a poorer effect on weakening or strengthening the coupling between the two resonance modes by using the first tuning mechanical part.

Further, opening grooves are provided on respective outer end portions of two adjacent components. As shown in FIG. 1A and FIG. 1B, a second tuning mechanical part T2 is disposed in one opening groove, and a third tuning mechanical part T3 is disposed in the other opening groove. The components provided with the opening grooves are partially hollowed out due to the opening grooves. Therefore, compared with components provided with no opening groove, the components provided with the opening grooves are relatively long, to compensate for increased frequencies caused by the opening grooves, and the opening grooves facilitate control over solder when a cover plate is welded.

For example, the second tuning mechanical part T2 and the third tuning mechanical part T3 may also specifically be tuning screws, other plastic or ceramic members, or members of mixed materials. However, this embodiment of this application is not limited thereto. In addition, materials of the second tuning mechanical part T2 and the third tuning mechanical part T3 may be the same, or materials of the second tuning mechanical part T2 and the third tuning mechanical part T3 may be different.

In addition to having advantages of the foregoing embodiments, this embodiment further has an advantage of tuning the coupling coefficient of the two resonance modes of the dual-mode resonator in a large range by using the second tuning mechanical part and the third tuning mechanical part.

Figure 2:
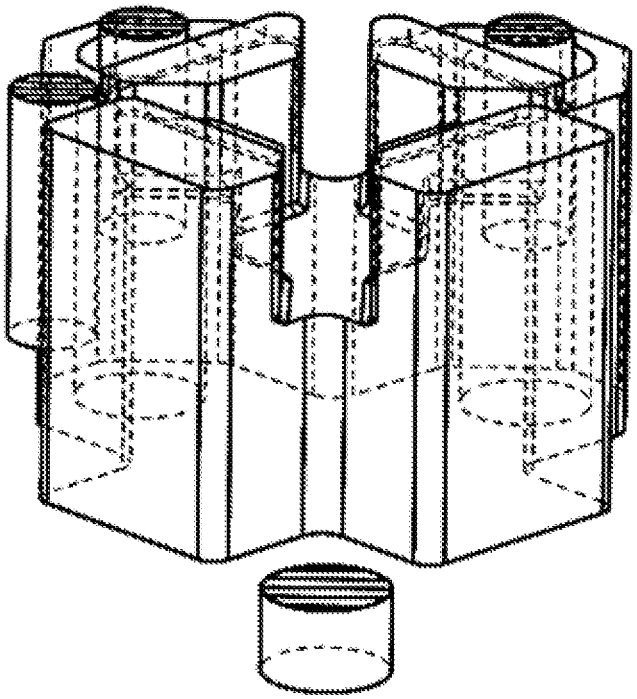
FIG. 2 is a side view of a dual-mode resonator according to an embodiment of this application.

Further, as shown in FIG. 2, the heights of the two adjacent components provided with the opening grooves are lower than the heights of other components. In this way, when the dual-mode dielectric body is connected to the inner surface of the cavity through welding or the like, fluid such as solder can be prevented from flowing to the second tuning mechanical part and/or the third tuning mechanical part, so that the heights/height of the second tuning mechanical part and/or the third tuning mechanical part can be adjusted (for example, adjusted through rotating). Therefore, it is ensured that the coupling coefficient of the two resonance modes of the dual-mode resonator can be tuned in a large range by using the second tuning mechanical part and the third tuning mechanical part.

In a possible implementation, the dual-mode resonator 10 further includes a fourth tuning mechanical part T4, where the fourth tuning mechanical part T4 is disposed at the bottom of the dual-mode dielectric body 11. A size and a shape of the fourth tuning mechanical part T4 are not limited in this embodiment of this application. In addition, the fourth tuning mechanical part T4 may specifically be a tuning screw, another plastic or ceramic member, or the like.

When the dual-mode resonator 10 includes the first tuning mechanical part T1, the second tuning mechanical part T2, the third tuning mechanical part T3, and the fourth tuning mechanical part T4 altogether, respective materials of the first tuning mechanical part T1, the second tuning mechanical part T2, the third tuning mechanical part T3, and the fourth tuning mechanical part T4 may be the same or different. For example, the first tuning mechanical part T1 is a metal screw, and the second tuning mechanical part T2, the third tuning mechanical part T3, and the fourth tuning mechanical part T4 are ceramic screws. Tuning mechanical parts are shown as circular parts with slashes in FIG. 1A. For a side view of a specific internal structure of the dual-mode resonator 10, refer to FIG. 2.

In addition, shapes and sizes of the first tuning mechanical part T1, the second tuning mechanical part T2, the third tuning mechanical part T3, and the fourth tuning mechanical part T4 may be designed based on an actual requirement. For example, the shape may be a circle or a square, and for a size that describes cooperation between the dual-mode dielectric body 11 and each mechanical part, a distance from the dual-mode dielectric body 11 to each mechanical part may be 1.5-2 mm.

In the foregoing embodiments, fourth tuning mechanical parts of different sizes are disposed at the bottom of the dual-mode dielectric body, so that harmonics, for example, effective remote harmonics, of the dual-mode resonator can be tuned in a large range when a main mode of the dual-mode resonator is slightly affected.

Figure 3:
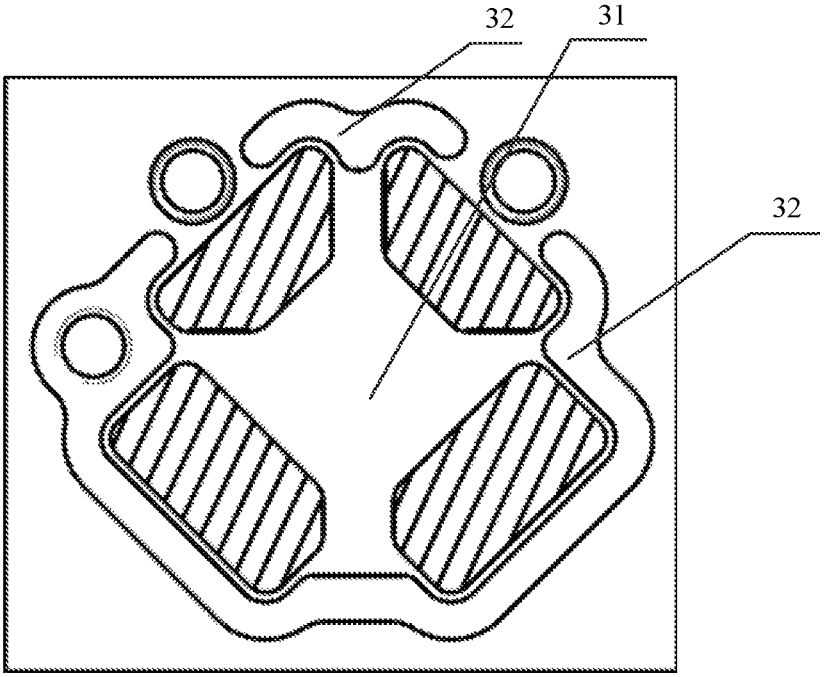
FIG. 3 is a top view of a cover plate of a dual-mode resonator according to an embodiment of this application.

FIG. 3 is a top view of a cover plate of a dual-mode resonator according to an embodiment of this application. As shown in FIG. 3, the dual-mode dielectric body is connected to the inner surface of the cavity by using a cover plate 31.

A material of the cover plate 31 may be a metal sheet such as an iron sheet or a copper sheet, a printed circuit board, or the like. This is not limited in this embodiment of this application.

Optionally, the cover plate 31 of a secondary body and the inner surface of the cavity may be connected to each other in any one or more of the following connection manners: different processes such as welding and bonding.

Specifically, referring to FIG. 1B or FIG. 3, parts with slashes represent contact surfaces between the dual-mode dielectric body and the cover plate 31. The dual-mode dielectric body is first connected to the cover plate 31, and then the cover plate 31 is connected to the inner surface of the outer cavity, to reduce a connecting stress between the dual-mode dielectric body and the cavity, and improve reliability of the dual-mode resonator.

Optionally, there is one contact surface between the dual-mode dielectric body and the cover plate 31; there are two contact surfaces between the dual-mode dielectric body and the cover plate 31; there are three contact surfaces between the dual-mode dielectric body and the cover plate 31; there are four contact surfaces between the dual-mode dielectric body and the cover plate 31; or a quantity of contact surfaces is adjusted based on different designs.

In a possible implementation, there are a plurality of cover plates. In this case, the parts with slashes represent the cover plates.

Further, as shown in FIG. 3, an additional groove 32 may be provided on a periphery of the cover plate 31, to further reduce the stress between the dual-mode dielectric body and the cavity. There may be one or more grooves 32, for example, two grooves shown in FIG. 3. In addition, the shape of the grooves 32 is not limited.

The subsequent embodiments are separately independent of the foregoing embodiments, and same technical terms in the subsequent embodiments have the same effects, functions, and structures as those in the foregoing embodiments, and details are not subsequently described.

An embodiment of this application provides a dual-mode resonator, including a cavity and a dual-mode dielectric body coupled to an inner surface of the cavity. The dual-mode dielectric body includes a central part and four components that protrude from the central part, and the four components are disposed opposite to each other in pair and are in a cross shape. Opening grooves are provided on respective outer end portions of two adjacent components, a second tuning mechanical part is disposed in one opening groove, and a third tuning mechanical part is disposed in the other opening groove.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that a coupling coefficient of two resonance modes of the dual-mode resonator can be tuned in a large range by adjusting the heights of the second tuning mechanical part and the third tuning mechanical part.

The components provided with the opening grooves are partially hollowed out due to the opening grooves. Therefore, compared with components provided with no opening groove, the components provided with the opening grooves are relatively long, to compensate for increased frequencies caused by the opening grooves, and the opening grooves facilitate control over solder when a cover plate is welded.

For example, the second tuning mechanical part and the third tuning mechanical part may specifically be tuning screws or other plastic or ceramic members. However, this embodiment of this application is not limited thereto. In addition, materials of the second tuning mechanical part and the third tuning mechanical part may be the same, or materials of the second tuning mechanical part and the third tuning mechanical part may be different.

Optionally, the heights of the two adjacent components provided with the opening grooves are lower than the heights of other components. In this way, when the dual-mode dielectric body is connected to the inner surface of the cavity through welding or the like, fluid such as solder can be prevented from flowing to the second tuning mechanical part and/or the third tuning mechanical part, so that the heights/height of the second tuning mechanical part and/or the third tuning mechanical part can be adjusted (for example, adjusted through rotating). Therefore, it is ensured that the coupling coefficient of the two resonance modes of the dual-mode resonator is tuned in a large range by using the second tuning mechanical part and the third tuning mechanical part.

Optionally, a first coupling groove and a second coupling groove are provided on the central part, an extension direction of the first coupling groove is between two adjacent components, and an extension direction of the second coupling groove is between the other two adjacent components. The widths and/or the depths of the first coupling groove and the second coupling groove are different, and the extension direction of the first coupling groove and the extension direction of the second coupling groove are at a preset angle.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that the coupling coefficient of the two resonance modes of the dual-mode resonator can be tuned in a large range by adjusting the heights of the second tuning mechanical part and the third tuning mechanical part. In addition, the first coupling groove and the second coupling groove are provided on the central part, where the extension direction of the first coupling groove is between the two adjacent components, the extension direction of the second coupling groove is between the other two adjacent components, the widths and/or the depths of the first coupling groove and the second coupling groove are different, and the extension direction of the first coupling groove and the extension direction of the second coupling groove are at the preset angle. For example, the first coupling groove is provided between a horizontally disposed component and a vertically disposed component among the four components disposed in the shape of the cross of the lines perpendicular to each other, and is in the shape of "/"; and the second coupling groove is also provided between a horizontally disposed component and a vertically disposed component among the four components disposed in the shape of the cross of the lines perpendicular to each other, and is in the shape of "\". The first coupling groove and the second coupling groove are provided, so that there can be a relatively large coupling coefficient between the two resonance modes of the dual-mode resonator, and therefore, the dual-mode resonator has relatively wide bandwidth. In addition, the widths and/or the depths of the first coupling groove and the second coupling groove are different, so that positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

Optionally, when the depth of the first coupling groove is equal to the depth of the second coupling groove, and the width of the first coupling groove is greater than the width of the second coupling groove, the two resonance modes of the dual-mode resonator are positively coupled. Alternatively, when the width of the first coupling groove is equal to the width of the second coupling groove, and the depth of the first coupling groove is greater than the depth of the second coupling groove, the two resonance modes of the dual-mode resonator are positively coupled.

Optionally, when the depth of the first coupling groove is equal to the depth of the second coupling groove, and the width of the first coupling groove is less than the width of the second coupling groove, the two resonance modes of the dual-mode resonator are negatively coupled. Alternatively, when the width of the first coupling groove is equal to the width of the second coupling groove, and the depth of the first coupling groove is greater than the depth of the second coupling groove, the two resonance modes of the dual-mode resonator are negatively coupled.

Optionally, both the first coupling groove and the second coupling groove are long-strip-shaped grooves; both the first coupling groove and the second coupling groove are in a shape deformed from the long-strip-shape; one of the first coupling groove and the second coupling groove is a long-strip-shaped groove, and the other one is in a shape deformed from the long-strip-shape; or the first coupling groove and the second coupling groove are in other shapes.

Optionally, the first coupling groove and the second coupling groove are perpendicular to each other.

Optionally, the dual-mode resonator may further include a first tuning mechanical part, and the first tuning mechanical part is adjacent to the first coupling groove or the second coupling groove. When the first tuning mechanical part is adjacent to the first coupling groove, coupling may be weakened by using the first tuning mechanical part. When the first tuning mechanical part is adjacent to the second coupling groove, coupling may be strengthened by using the first tuning mechanical part. Therefore, the coupling coefficient of the two resonance modes of the dual-mode resonator is conveniently tuned in a large range. For example, the first tuning mechanical part may specifically be a tuning screw or another plastic or ceramic member. However, this embodiment of this application is not limited thereto.

Optionally, the dual-mode resonator further includes a fourth tuning mechanical part, where the fourth tuning mechanical part is disposed at the bottom of the dual-mode dielectric body. Fourth tuning mechanical parts of different sizes are disposed at the bottom of the dual-mode dielectric body, so that harmonics of the dual-mode resonator can be tuned in a large range when a main mode of the dual-mode resonator is slightly affected. Similarly, the fourth tuning mechanical part may specifically be a tuning screw or another plastic or ceramic member. However, this embodiment of this application is not limited thereto. When the dual-mode resonator includes the first tuning mechanical part, the second tuning mechanical part, the third tuning mechanical part, and the fourth tuning mechanical part altogether, respective materials of the first tuning mechanical part, the second tuning mechanical part, the third tuning mechanical part, and the fourth tuning mechanical part may be the same or different. For example, the first tuning mechanical part is a metal screw, and the second tuning mechanical part, the third tuning mechanical part, and the fourth tuning mechanical part are ceramic screws.

In addition, shapes and sizes of the first tuning mechanical part, the second tuning mechanical part, the third tuning mechanical part, and the fourth tuning mechanical part may be designed based on an actual requirement. For example, the shape may be a circle or a square, and for a size that describes cooperation between the dual-mode dielectric body and each mechanical part, a distance from the dual-mode dielectric body to each mechanical part may be 1.5-2 mm.

Optionally, the dual-mode dielectric body is connected to the inner surface of the cavity by using the cover plate of a secondary body. In this way, a connecting stress between the dual-mode dielectric body and the cavity can be reduced, and reliability of the dual-mode resonator can be improved. The cover plate may be a metal sheet such as an iron sheet or a copper sheet, a printed circuit board, or the like. This is not limited in this embodiment of this application.

Optionally, there is one contact surface between the dual-mode dielectric body and the cover plate; there are two contact surfaces between the dual-mode dielectric body and the cover plate; there are three contact surfaces between the dual-mode dielectric body and the cover plate; there are four contact surfaces between the dual-mode dielectric body and the cover plate; or there may be another quantity of contact surfaces between the dual-mode dielectric body and the cover plate.

In a possible implementation, there are a plurality of cover plates.

Optionally, the cover plate of the secondary body and the inner surface of the cavity may be connected to each other in any one or more of the following connection manners: different processes such as welding and bonding.

Optionally, an additional groove is provided on a periphery of the cover plate, to further reduce the stress between the dual-mode dielectric body and the cavity.

An embodiment of this application further provides a dual-mode resonator, including a cavity, a dual-mode dielectric body coupled to an inner surface of the cavity, and a fourth tuning mechanical part disposed at the bottom of the dual-mode dielectric body. The dual-mode dielectric body includes a central part and four components that protrude from the central part, and the four components are disposed opposite to each other in pair and are in a cross shape. Fourth tuning mechanical parts of different sizes are disposed at the bottom of the dual-mode dielectric body, so that harmonics of the dual-mode resonator can be tuned in a large range when a main mode of the dual-mode resonator is slightly affected.

The fourth tuning mechanical part may specifically be a tuning screw or another plastic or ceramic member. However, this embodiment of this application is not limited thereto.

Optionally, opening grooves are provided on respective outer end portions of two adjacent components, a second tuning mechanical part is disposed in one opening groove, and a third tuning mechanical part is disposed in the other opening groove. The components provided with the opening grooves are partially hollowed out due to the opening grooves. Therefore, compared with components provided with no opening groove, the components provided with the opening grooves are relatively long, to compensate for increased frequencies caused by the opening grooves, and the opening grooves facilitate control over solder when a cover plate is welded.

The dual-mode dielectric body of the dual-mode resonator includes the central part and the four components that protrude from the central part, and the four components are disposed opposite to each other in pair and are in the cross shape, for example, in the shape of "X" or a cross of lines perpendicular to each other; and the opening grooves are provided on the respective outer end portions of the two adjacent components, the second tuning mechanical part is disposed in one opening groove, and the third tuning mechanical part is disposed in the other opening groove, so that a coupling coefficient of two resonance modes of the dual-mode resonator can be tuned in a large range by adjusting the heights of the second tuning mechanical part and the third tuning mechanical part.

For example, the second tuning mechanical part and the third tuning mechanical part may also specifically be tuning screws or other plastic or ceramic members. However, this embodiment of this application is not limited thereto. In addition, materials of the second tuning mechanical part and the third tuning mechanical part may be the same, or materials of the second tuning mechanical part and the third tuning mechanical part may be different.

Optionally, the heights of the two adjacent components provided with the opening grooves are lower than the heights of other components. In this way, when the dual-mode dielectric body is connected to the inner surface of the cavity through welding or the like, fluid such as solder can be prevented from flowing to the second tuning mechanical part and/or the third tuning mechanical part, so that the heights/height of the second tuning mechanical part and/or the third tuning mechanical part can be adjusted (for example, adjusted through rotating). Therefore, it is ensured that the coupling coefficient of the two resonance modes of the dual-mode resonator is tuned in a large range by using the second tuning mechanical part and the third tuning mechanical part.

Optionally, a first coupling groove and a second coupling groove having different widths are provided on the central part, an extension direction of the first coupling groove is between two adjacent components, and an extension direction of the second coupling groove is between the other two adjacent components. The extension direction of the first coupling groove and the extension direction of the second coupling groove are at a preset angle.

The dual-mode resonator includes: the cavity, the dual-mode dielectric body coupled to the inner surface of the cavity, and the fourth tuning mechanical part disposed at the bottom of the dual-mode dielectric body. The dual-mode dielectric body includes the central part and the four components that protrude from the central part, and the four components are disposed opposite to each other in pair and are in a cross shape, for example, in the shape of "X" or a cross of lines perpendicular to each other. Fourth tuning mechanical parts of different sizes are disposed at the bottom of the dual-mode dielectric body, so that the harmonics of the dual-mode resonator can be tuned in a large range when the main mode of the dual-mode resonator is slightly affected. In addition, the first coupling groove and the second coupling groove are provided on the central part, where the extension direction of the first coupling groove is between the two adjacent components, the extension direction of the second coupling groove is between the other two adjacent components, the widths and/or the depths of the first coupling groove and the second coupling groove are different, and the extension direction of the first coupling groove and the extension direction of the second coupling groove are at the preset angle. For example, the first coupling groove is provided between a horizontally disposed component and a vertically disposed component among the four components disposed in the shape of the cross of the lines perpendicular to each other, and is in the shape of "/"; and the second coupling groove is also provided between a horizontally disposed component and a vertically disposed component among the four components disposed in the shape of the cross of the lines perpendicular to each other, and is in the shape of "\". The first coupling groove and the second coupling groove are provided, so that there can be a relatively large coupling coefficient between the two resonance modes of the dual-mode resonator, and therefore, the dual-mode resonator has relatively wide bandwidth. In addition, the widths and/or the depths of the first coupling groove and the second coupling groove are different, so that positive and negative coupling of the dual-mode resonator can be controlled by adjusting the widths and/or the depths of the first coupling groove and the second coupling groove, thereby implementing independent control over the positive and negative coupling and coupling strength of the dual-mode resonator.

Optionally, when the depth of the first coupling groove is equal to the depth of the second coupling groove, and the width of the first coupling groove is greater than the width of the second coupling groove, the two resonance modes of the dual-mode resonator are positively coupled. Alternatively, when the width of the first coupling groove is equal to the width of the second coupling groove, and the depth of the first coupling groove is greater than the depth of the second coupling groove, the two resonance modes of the dual-mode resonator are positively coupled.

Optionally, when the depth of the first coupling groove is equal to the depth of the second coupling groove, and the width of the first coupling groove is less than the width of the second coupling groove, the two resonance modes of the dual-mode resonator are negatively coupled. Alternatively, when the width of the first coupling groove is equal to the width of the second coupling groove, and the depth of the first coupling groove is greater than the depth of the second coupling groove, the two resonance modes of the dual-mode resonator are negatively coupled.

Optionally, both the first coupling groove and the second coupling groove are long-strip-shaped grooves; both the first coupling groove and the second coupling groove are in a shape deformed from the long-strip-shape; one of the first coupling groove and the second coupling groove is a long-strip-shaped groove, and the other one is in a shape deformed from the long-strip-shape; or the first coupling groove and the second coupling groove are in other shapes.

Optionally, the first coupling groove and the second coupling groove are perpendicular to each other.

Optionally, the dual-mode resonator may further include a first tuning mechanical part, and the first tuning mechanical part is adjacent to the first coupling groove or the second coupling groove. When the first tuning mechanical part is adjacent to the first coupling groove, coupling may be weakened by using the first tuning mechanical part. When the first tuning mechanical part is adjacent to the second coupling groove, coupling may be strengthened by using the first tuning mechanical part. Therefore, the coupling coefficient of the two resonance modes of the dual-mode resonator is conveniently tuned in a large range. For example, the first tuning mechanical part may specifically be a tuning screw or another plastic or ceramic member. However, this embodiment of this application is not limited thereto.

When the dual-mode resonator includes the first tuning mechanical part, the second tuning mechanical part, the third tuning mechanical part, and the fourth tuning mechanical part altogether, respective materials of the first tuning mechanical part, the second tuning mechanical part, the third tuning mechanical part, and the fourth tuning mechanical part may be the same or different. For example, the first tuning mechanical part is a metal screw, and the second tuning mechanical part, the third tuning mechanical part, and the fourth tuning mechanical part are ceramic screws. In addition, shapes and sizes of the first tuning mechanical part, the second tuning mechanical part, the third tuning mechanical part, and the fourth tuning mechanical part may be designed based on an actual requirement. For example, the shape may be a circle or a square, and for a size that describes cooperation between the dual-mode dielectric body and each mechanical part, a distance from the dual-mode dielectric body to each mechanical part may be 1.5-2 mm.

Optionally, the dual-mode dielectric body is connected to the inner surface of the cavity by using a cover plate of a secondary body. In this way, a connecting stress between the dual-mode dielectric body and the cavity can be reduced, and reliability of the dual-mode resonator can be improved. The cover plate may be a metal sheet such as an iron sheet or a copper sheet, a printed circuit board, or the like. This is not limited in this embodiment of this application.

Optionally, there is one contact surface between the dual-mode dielectric body and the cover plate; there are two contact surfaces between the dual-mode dielectric body and the cover plate; there are three contact surfaces between the dual-mode dielectric body and the cover plate; there are four contact surfaces between the dual-mode dielectric body and the cover plate; or there may be another quantity of contact surfaces between the dual-mode dielectric body and the cover plate.

In a possible implementation, there are a plurality of cover plates.

Optionally, the cover plate of the secondary body and the inner surface of the cavity may be connected to each other in any one or more of the following connection manners: different processes such as welding and bonding.

Optionally, an additional groove is provided on a periphery of the cover plate, to further reduce a stress between the dual-mode dielectric body and the cavity.

An embodiment of this application further provides a filter, where the filter includes at least one dual-mode resonator according to any one of the foregoing embodiments.

An embodiment of this application further provides a radio frequency unit, where the radio frequency unit includes at least one filter. The filter includes at least one dual-mode resonator according to any one of the foregoing embodiments.

Although only some components and embodiments of this application have been illustrated and described, without actually departing from the scope and spirit of the claims, persons skilled in the art may consider many modifications and changes (for example, changes in magnitudes, sizes, structures, shapes and ratios, installation arrangements, materials, colors, orientations, and the like of elements). In addition, to provide a brief description of the example embodiments, all components (namely, components that are currently considered to be irrelevant to an optimal resonance mode for performing this application or components that are irrelevant to implementing the claimed invention) in an actual implementation may not be described. It should be understood that in the development of any such actual implementation, as in any project or design project, several specific implementation decisions may be made. Such development may be complex and time-consuming, but for persons of ordinary skill who benefit from this application, it will still be a routine for design, processing and manufacturing without excessive experiments.

Finally, it should be noted that the foregoing embodiments are merely intended for describing the technical solutions of this application other than limiting this application. Although the embodiments of this application are described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of this application.

What is claimed is:

1. A dual-mode resonator, comprising: a cavity and a dual-mode dielectric body coupled to an inner surface of the cavity, wherein the dual-mode dielectric body is connected to the inner surface of the cavity by using a cover plate, wherein the dual-mode dielectric body comprises a central part and four components that protrude from the central part, wherein the four components are disposed opposite to each other in pair and are in a cross shape, wherein a first coupling groove and a second coupling groove are provided on the central part, wherein an extension direction of the first coupling groove is between two adjacent components of the four components, wherein an extension direction of the second coupling groove is between the other two adjacent components of the four components, wherein at least one of widths or depths of the first coupling groove and the second coupling groove are different, and wherein the extension direction of the first coupling groove and the extension direction of the second coupling groove are at a preset angle.

2. The dual-mode resonator according to claim 1, wherein when the depth of the first coupling groove is equal to the depth of the second coupling groove, and when the width of the first coupling groove is greater than the width of the second coupling groove, two resonance modes of the dual-mode resonator are positively coupled; or wherein when the width of the first coupling groove is equal to the width of the second coupling groove, and when the depth of the first coupling groove is greater than the depth of the second coupling groove, two resonance modes of the dual-mode resonator are positively coupled.

3. The dual-mode resonator according to claim 1, wherein when the depth of the first coupling groove is equal to the depth of the second coupling groove, and when the width of the first coupling groove is less than the width of the second coupling groove, two resonance modes of the dual-mode resonator are negatively coupled; or wherein when the width of the first coupling groove is equal to the width of the second coupling groove, and when the depth of the first coupling groove is greater than the depth of the second coupling groove, the two resonance modes of the dual-mode resonator are negatively coupled.

4. The dual-mode resonator according to claim 1, wherein both the first coupling groove and the second coupling groove are long-strip-shaped grooves.

5. The dual-mode resonator according to claim 1, wherein the first coupling groove and the second coupling groove are perpendicular to each other.

6. The dual-mode resonator according to claim 1, wherein the dual-mode resonator further comprises a first tuning mechanical part, and wherein the first tuning mechanical part is adjacent to the first coupling groove or the second coupling groove.

7. The dual-mode resonator according to claim 1, wherein the dual-mode resonator further comprises:

a fourth tuning mechanical part, wherein the fourth tuning mechanical part is disposed at a bottom of the dual-mode dielectric body.

8. The dual-mode resonator according to claim 1, wherein:

there is one contact surface between the dual-mode dielectric body and the cover plate;

there are two contact surfaces between the dual-mode dielectric body and the cover plate;

there are three contact surfaces between the dual-mode dielectric body and the cover plate; or there are four contact surfaces between the dual-mode dielectric body and the cover plate.

9. The dual-mode resonator according to claim 1, wherein there are a plurality of cover plates.

10. The dual-mode resonator according to claim 1, wherein opening grooves are provided on respective outer end portions of two adjacent components of the four components, wherein a second tuning mechanical part is disposed in one opening groove, and wherein a third tuning mechanical part is disposed in the other opening groove.

11. The dual-mode resonator according to claim 10, wherein heights of the two adjacent components provided with the opening grooves are lower than heights of other components.

12. A filter, comprising at least one dual-mode resonator, wherein:

the dual-mode resonator comprises a cavity and a dual-mode dielectric body coupled to an inner surface of the cavity, wherein the dual-mode dielectric body is connected to the inner surface of the cavity by using a cover plate, wherein the dual-mode dielectric body comprises a central part and four components that protrude from the central part, wherein the four components are disposed opposite to each other in pair and are in a cross shape, wherein a first coupling groove and a second coupling groove are provided on the central part, wherein an extension direction of the first coupling groove is between two adjacent components of the four components, wherein an extension direction of the second coupling groove is between the other two adjacent components of the four components, wherein at least one of widths or depths of the first coupling groove and the second coupling groove are different, and wherein the extension direction of the first coupling groove and the extension direction of the second coupling groove are at a preset angle.

13. The filter according to claim 12, wherein when the depth of the first coupling groove is equal to the depth of the second coupling groove, and when the width of the first coupling groove is greater than the width of the second coupling groove, two resonance modes of the dual-mode resonator are positively coupled; or wherein when the width of the first coupling groove is equal to the width of the second coupling groove, and when the depth of the first coupling groove is greater than the depth of the second coupling groove, two resonance modes of the dual-mode resonator are positively coupled.

14. The filter according to claim 12, wherein when the depth of the first coupling groove is equal to the depth of the second coupling groove, and when the width of the first coupling groove is less than the width of the second coupling groove, two resonance modes of the dual-mode resonator are negatively coupled; or wherein when the width of the first coupling groove is equal to the width of the second coupling groove, and when the depth of the first coupling groove is greater than the depth of the second coupling groove, the two resonance modes of the dual-mode resonator are negatively coupled.

15. The filter according to claim 12, wherein both the first coupling groove and the second coupling groove are long-strip-shaped grooves.

16. The filter according to claim 12, wherein the first coupling groove and the second coupling groove are perpendicular to each other.

17. The filter according to claim 12, wherein the dual-mode resonator further comprises a first tuning mechanical part, and wherein the first tuning mechanical part is adjacent to the first coupling groove or the second coupling groove.

18. The filter according to claim 12, wherein opening grooves are provided on respective outer end portions of two adjacent components of the four components, wherein a second tuning mechanical part is disposed in one opening groove, and wherein a third tuning mechanical part is disposed in the other opening groove.

19. A radio frequency unit, comprising at least one filter, wherein the filter comprises at least one dual-mode resonator, wherein:

the dual-mode resonator comprises a cavity and a dual-mode dielectric body coupled to an inner surface of the cavity, wherein the dual-mode dielectric body is connected to the inner surface of the cavity by using a cover plate, wherein the dual-mode dielectric body comprises a central part and four components that protrude from the central part, wherein the four components are disposed opposite to each other in pair and are in a cross shape, wherein a first coupling groove and a second coupling groove are provided on the central part, wherein an extension direction of the first coupling groove is between two adjacent components of the four components, wherein an extension direction of the second coupling groove is between the other two adjacent components of the four components, wherein at least one of widths or depths of the first coupling groove and the second coupling groove are different, and wherein the extension direction of the first coupling groove and the extension direction of the second coupling groove are at a preset angle.

* * * * *